US007429442B2

(12) United States Patent
Honda et al.

(10) Patent No.: US 7,429,442 B2
(45) Date of Patent: Sep. 30, 2008

(54) TONER, AND TWO COMPONENT DEVELOPER AND IMAGE FORMING APPARATUS USING THE TONER

(75) Inventors: Takahiro Honda, Numazu (JP); Masami Tomita, Numazu (JP); Toshiki Nanya, Mishima (JP); Fumihiro Sasaki, Fuji (JP); Shigeru Emoto, Numazu (JP); Hiroto Higuchi, Numazu (JP); Hiroshi Yamada, Numazu (JP); Shinichiro Yagi, Numazu (JP); Tomomi Suzuki, Numazu (JP); Junichi Awamura, Suntou-gun (JP); Naohito Shimota, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 373 days.

(21) Appl. No.: 11/061,477

(22) Filed: Feb. 22, 2005

(65) Prior Publication Data

US 2005/0186498 A1 Aug. 25, 2005

(30) Foreign Application Priority Data

Feb. 20, 2004 (JP) ..... 2004-044257

(51) Int. Cl.
*G03G 9/08* (2006.01)

(52) U.S. Cl. ..... 430/110.3; 430/110.4; 430/137.1; 399/262

(58) Field of Classification Search ..... 430/110.3, 430/110.4, 137.1, 109, 111; 399/262
See application file for complete search history.

(56) References Cited

U.S. PATENT DOCUMENTS 4,082,681 A 4/1978 Takayama et al.
4,108,786 A 8/1978 Takayama et al.
4,254,201 A * 3/1981 Sawai et al. ..... 430/110.2
5,354,640 A 10/1994 Kanbayashi et al.
6,033,820 A * 3/2000 Hayashi et al. ..... 430/108.22
6,756,175 B2 6/2004 Emoto et al.
7,041,420 B2 * 5/2006 Vandewinckel et al. .. 430/107.1
2001/0051051 A1 12/2001 Matsumoto
2002/0039698 A1 4/2002 Sasaki et al.
2002/0081513 A1 6/2002 Higuchi et al.
2003/0077536 A1 4/2003 Yamashita et al.
2003/0082472 A1 5/2003 Kondo et al.

(Continued)

FOREIGN PATENT DOCUMENTS

EP 0 504 942 A1 9/1992

(Continued)

OTHER PUBLICATIONS

Derwent Publications, AN 2000-675479, XP-002328073, JP 2000-258955, Sep. 22, 2000.

(Continued)

*Primary Examiner*—John L. Goodrow
(74) *Attorney, Agent, or Firm*—Oblon, Spivak, McClelland, Maier & Neustadt, P.C.

(57) ABSTRACT

A toner is provided that contains a binder resin; a colorant; a release agent; and an external additive, wherein the toner has an average circularity of from 0.940 to 0.965 and a crater having a depth of from 0.02 to 0.1 μm, and wherein the crater has an amount of the external additive larger than an average amount thereof on the toner, along with a two-component developer containing the toner and an image forming apparatus using the toner.

15 Claims, 4 Drawing Sheets

U.S. PATENT DOCUMENTS

| | | | | |
|---|---|---|---|---|
| 2003/0096185 | A1 | 5/2003 | Yamashita et al. | |
| 2003/0134220 | A1 | 7/2003 | Emoto et al. | |
| 2003/0152859 | A1* | 8/2003 | Emoto et al. | 430/109.4 |
| 2004/0053154 | A1 | 3/2004 | Tomita et al. | |
| 2004/0106057 | A1* | 6/2004 | Tomita et al. | 430/108.6 |
| 2004/0131961 | A1* | 7/2004 | Watanabe et al. | 430/108.4 |
| 2004/0142265 | A1 | 7/2004 | Tomita et al. | |
| 2004/0146795 | A1 | 7/2004 | Emoto et al. | |
| 2004/0166428 | A1 | 8/2004 | Higuchi et al. | |
| 2004/0166429 | A1 | 8/2004 | Higuchi et al. | |

FOREIGN PATENT DOCUMENTS

| | | |
|---|---|---|
| JP | 2-284163 | 11/1990 |
| JP | 4-162048 | 6/1992 |
| JP | 11-184145 | 7/1999 |
| JP | 2000-292978 | 10/2000 |
| JP | 2002-174934 | 6/2002 |
| JP | 2002-207317 | 7/2002 |
| JP | 2002-284881 | 10/2002 |
| JP | 2002-287400 | 10/2002 |
| JP | 2003-5446 | 1/2003 |
| JP | 2003-107777 | 4/2003 |
| JP | 2003-140378 | 5/2003 |
| JP | 2003-140381 | 5/2003 |
| JP | 2003-280269 | 10/2003 |
| JP | 2004-4414 | 1/2004 |
| JP | 2004-37516 | 2/2004 |
| JP | 2004-54204 | 2/2004 |

OTHER PUBLICATIONS

Derwent Publications, AN 1976-71034X, XP-002328074, JP 51-088227, Aug. 2, 1976.

Derwent Publications, AN 1991-203306, XP-002328075, JP 03-126956, May 30, 1991.

U.S. Appl. No. 12/013,108, filed Jan. 11, 2008, Yagi et al.

U.S. Appl. No. 11/855,806, filed Sep. 14, 2007, Awamura et al.

U.S. Appl. No. 11/856,379, filed Sep. 17, 2007, Sawada et al.

* cited by examiner

TONER, AND TWO COMPONENT DEVELOPER AND IMAGE FORMING APPARATUS USING THE TONER

BACKGROUND OF THE INVENTION

1. Field of the Invention

The present invention relates to a toner for use in copiers, facsimiles and printers and the like using electrophotographic image forming methods; a two-component developer using the toner; and an image forming apparatus using the two-component developer.

2. Discussion of the Background

The electrophotographic image forming method includes a charging process charging a surface of a photoreceptor which is an image bearer with an electric discharge, an irradiating process irradiating the charged surface of the photoreceptor to form an electrostatic latent image, a developing process developing the electrostatic latent image formed on the surface of the photoreceptor with a toner to form a toner image, a transfer process transferring the toner image on the surface of the photoreceptor onto a surface of a transfer body, a fixing process fixing the toner image on the surface of the transfer body and a cleaning process removing the toner remaining on the surface of the image bearer after the transfer process.

Recently, color image forming apparatuses using the electrophotographic image forming method are widely used, and digitalized images are available with ease and printed images are required to have higher image definitions. While higher image resolution and gradient are studied, the toner visualizing the latent image is studied to have further sphericity and smaller particle diameter to form a high definition images. As the toner prepared by pulverizing methods has a limit of these properties, polymerized toners prepared by suspension polymerizing methods, emulsification polymerizing methods and dispersion polymerizing methods capable of conglobating the toner and making the toner have a small particle diameter are being used.

The toner having a shape close to a true sphere is easily affected by a line of electric force in an electrostatic developing method and is faithfully developed along the line of electric force of an electrostatic latent image on a photoreceptor. When a minute latent image dot is reproduced, the toner are precisely and uniformly located to have a high thin line reproducibility. In an electrostatic transfer method, as the toner has a smooth surface and a good powder fluidity, the toner particles less adhere each other and to the photoreceptor, and therefore the toner is easily affected by a line of electric force and is faithfully transferred along the line of electric force, i.e., the toner has a high transferability.

However, the toner having a shape close to a true sphere has a smaller surface area than an amorphous toner, i.e., has less surface area which can effectively used for frictional charge by a magnetic carrier and friction charging members such as developer regulating members. The spheric toner easily slip on a surface of the friction charging member and charged speed and level thereof decrease, and therefore a specific amount or more of a charge controlling agent is needed therefor.

In addition, as the toner having a smaller particle diameter to improve minute dot reproducibility has a larger superficial area, and an external additive is used in a large amount. Since the external additive largely changes frictional chargeability of the toner, it is essential for the toner to have chargeability, developability and transferability.

Japanese Laid-Open Patent Publication No. 11-184145 discloses a developer comprising a toner comprising a binder resin and a colorant, a particulate silica and a particulate resin, wherein the particulate silica is a mixture of a first particulate silica and a second particulate silica having a different number-average particle diameter each other and present in an amount of 0.1 to 3.0% by weight per 100% by weight of the toner, the particulate resin is present in an amount of 0.01 to 0.1% by weight per 100% by weight of the toner, the first particulate silica having a smaller particle diameter relative to the second particulate silica has a number-average particle diameter less than 15 nm, the second particulate silica having a larger particle diameter relative to the first particulate silica has a number-average particle diameter of from 15 nm to 150 nm, and a ratio of the number-average particle diameter of second particulate silica having a larger particle diameter relative to the first particulate silica to that of the particulate resin is from 0.05 to 20. However, this method simply adds a mixture of the silica and particulate resin to an external of the toner, and which will not have stable chargeability for long periods.

Japanese Laid-Open Patent Publication No. 2000-292978 discloses a toner comprising a low-molecular-weight resin, a polymer resin and a colorant, wherein the polymer resin is eccentrically-located adjacent to a surface of the toner, and preferably a particulate release agent is also eccentrically-located adjacent thereto. This provides a polymerized toner having hot offset resistance and good chargeability, and preventing a transfer sheet from being entwined around a fixer fixing a toner image upon application of heat, and a method of preparing the toner. However, the toner will not have stable chargeability for long periods.

Because of these reasons, a need exists for a toner having stable chargeability and fluidity even after used for long periods in an image developer.

SUMMARY OF THE INVENTION

Accordingly, one object of the present invention is to provide a toner having stable chargeability and fluidity even after used for long periods in an image developer.

Another object of the present invention is to provide a two-component developer using the toner.

A further object of the present invention is to provide an image forming apparatus using the toner or the two-component developer, capable of producing high-quality images without smudge such as foggy background for long periods.

These objects and other objects of the present invention, either individually or collectively, have been satisfied by the discovery of a toner comprising, at least one of each of the following components:

a binder resin;

a colorant;

a release agent; and an external additive, wherein the toner has an average circularity of from 0.940 to 0.965 and comprises, on the toner surface, at least one crater having a depth of from 0.02 to 0.1 μm, wherein the at least one crater contains an amount of the external additive per unit of surface area that is larger than an average amount of the external additive per unit of surface area thereof on the toner.

In addition, the toner preferably has a ratio of an area of each crater to an area of a remainder of the toner surface is from 0.1 to 0.4, wherein the remainder of the toner surface comprises surface area other than the surface of the crater being measured.

Further, the toner preferably comprises an organic particulate resin, wherein the crater is formed from an existential status of the organic particulate resin.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1A:
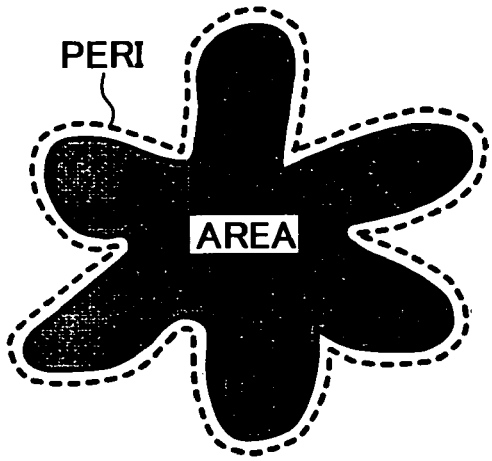
FIGS. 1A and 1B are schematic views illustrating shapes of toners for explaining shape factors SF-1 and SF-2.

The present invention provides a toner having stable chargeability and fluidity even after used for long periods in an image developer; a two-component developer using the toner; and an image forming apparatus using the toner or the two-component developer, capable of producing high-quality images without smudge such as foggy background for long periods.

The toner of the present invention is used in an electrophotographic image forming apparatus, and includes at least a binder resin, a colorant and a release agent, and externally includes an external additive. The toner can be prepared by a pulverization method or polymerization methods such as a suspension polymerization method, an emulsion dispersion method, an emulsion agglomeration method and an emulsion association. However, the methods are not limited thereto. The pulverization method includes fully mixing the above-mentioned resin, a pigment or a dye as the colorant, a charge controlling agent, the release agent and other additives with a mixer such as HENSCHEL MIXER to prepare a mixture; well kneading the mixture upon application of heat with a heating kneader such as a batch-type two-roll mill, BUNBURY MIXER, a continuous biaxial extruder and a continuous uniaxial kneader to prepare a kneaded mixture; extending and cooling the kneaded mixture upon application of pressure to prepare an extended and cooled mixture; and shearing the extended and cooled mixture to prepare a shorn mixture. The shorn mixture is crashed by a hammer mill or the like, and pulverized by a pulverizer using a jet stream or a mechanical pulverizer to prepare a pulverized mixture. The pulverized mixture is further classified by a classifier using a whirling stream or a classifier using a Coanda effect to prepare a toner particle having a predetermined particle diameter. Then, the toner particle is mixed with an inorganic particulate material by a mixer to prepare a toner.

The toner of the present invention has an average circularity of from 0.640 to 0.965. The circularity of a toner prepared by the pulverization method can thermally or mechanically be controlled. For example, the circularity can thermally be controlled by spraying the toner particle with a thermal current onto an atomizer or the like. In addition, the circularity can mechanically be controlled by mixing the toner particle with a mixing medium such as a glass having a low specific gravity with a mixer such as a ball mill. However, agglomerated toner particles having a large particle diameter arise in the thermal control and a fine powder arises in the mechanical control, and therefore the toner particles need to be classified again. A shape of a toner prepared in an aqueous medium can be controlled by strongly stirring the aqueous medium when a solvent is removed. The circularity SR is defined by the following formula:

$SR$=a circumferential length of a circle having an area equivalent to a projected area of a particle/a circumferential length of the projected area of a particle×100%

The closer to a true sphere, the closer to 100%. A toner having a high circularity is easily affected by an electric flux line on a carrier or a developing sleeve, and the toner is faithfully developed along the electric flux line of an electrostatic latent image. When a microscopic latent image dot is reproduced, the toner is precisely and uniformly positioned to faithfully reproduce thin line images. However, when the circularity of a toner is greater than 0.965, a cleaning blade poorly remove the toner in many cases. When less than 0.940, the toner is not fully charged or is reversely charged because the toner easily rolls off from a carrier, resulting in foggy background foggy images between thin lines.

A peripheral length of a circle having an area equivalent to that of a projected image optically detected is divided by an actual peripheral length of the toner particle to determine the circularity of the toner. Specifically, the circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 150 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10,000 pieces/μl; and measuring the toner shape and distribution with the above-mentioned measurer.

The toner of the present invention comprises at least one crater having a depth of from 0.02 to 0.1 μm, and the crater has a larger amount of an external additive per unit surface area than an average amount of the external additive per unit of surface area thereof on the toner.

A size of the crater can be measured by an atom force microscope (AFM). The AFM precisely scans a probe or a sample in the three-dimensional direction with a scanner using a piezoelectric element and detects a force between the probe and sample as an interaction to analyze undulations on the sample. While a surface (XY plane) of the sample is scanned by the probe and a distance between the probe and sample (height of z-axis) is controlled such that the interaction is constantly maintained, the surface of the sample is traced. In the present invention, 1 square μm of a surface of the toner is traced and a three-dimensional surface roughness thereof is detected to measure the size of the crater thereon. A depth from a periphery of the crater is determined as the size thereof.

Further, the toner of the present invention includes an external additive, and the external additive is present in the crater in a larger amount per unit surface area than the other locations of the surface of the toner. The external additive is stirred with the toner and a mixing medium in a mixer, and mixing conditions thereof can control an existential status of the external additive on the surface of the toner.

The external additive present on the surface of the toner is buried in the toner when repeatedly receiving stresses from a stirring or a mixing screw in an image developer and from a transfer by a developing sleeve. The external additive is occasionally removed from the surface of the toner by the transfer by a developing sleeve. Thus, the external additive present on the surface of the toner decreases, resulting in deterioration of fluidity of the toner and increase or decrease of charge quantity thereof. When the fluidity of the toner deteriorates, fluidity, a powder density and transferability as a developer deteriorate. However, the crater on the surface of the toner receives less stress even when repeatedly used, and therefore the external additive in the crater is not buried and an amount thereof remains unchanged.

Since the external additive is also charged and the external additives act repulsively each other, and are moderately scattered on the surface of the toner. The external additives receiving repulsions on the surface of the toner and gather in the crater, and do not leave therefrom because of needing a large repulsion to leave therefrom. However, when the external additive on the surface of the toner decreases because of being buried or other reasons, the repulsions on the surface of the toner becomes less and the external additive in the crater leave therefrom, and is scattered again on the surface of the toner. Namely, a large amount of the external additive in the crater can compensate the external additives buried in and left from the surface of the toner.

As a toner concentration sensor measuring a toner density in an image developer, a combination of a light emitting element such as a LED and a light receiving element measures a height of a developer to detect the toner concentration. In addition, a magnetic permeability sensor in an image developer measures an amount of a developer passing through the sensor neighborhood to detect the toner concentration. In the other methods, a property change of a developer due to a change of the toner fluidity is used.

As for the magnetic permeability sensor, when a powder density of the toner deteriorates, a powder density of a developer including the toner deteriorates. Therefore, even when a specific volume of the developer passes by the magnetic permeability sensor, a less amount of a magnetic carrier passes through the sensor neighborhood and the toner concentration appears to be increased. Then, supply of the toner is stopped and the concentration thereof decreases, resulting in deterioration of image density.

However, as for the toner of the present invention, even when the external additive contributing to the fluidity and charge quantity of the toner on the surface thereof decreases, the external additive in the crater covers to prevent deterioration of the fluidity and variation of the charge quantity.

In the present invention, the crater has a depth of from 0.02 to 0.1 μm. When less than 0.2 μm, when frictionally charged with a contact to a friction charging member such as a developer regulating member or a magnetic carrier, the toner is not well charged because the surface thereof is too smooth and slippery. In addition, when less than 0.02 μm, the depth is so low that the external additive is buried and cannot be compensated. When greater than 0.1 μm, the fluidity and transferability of the toner deteriorate because the surface thereof is too rough. In addition, the depth so high that the external additive in the crater cannot cover those buried in the surface of the toner and left therefrom.

The toner of the present invention preferably has a ratio of an area of the at least one crater to an area of a remainder of the toner surface of from 0.1 to 0.4 (hereinafter referred to as an area ratio), wherein the remainder of the toner surface comprises surface area other than the surface of the crater being measured. When the area ratio is less than 0.1, the area of the crater is so small that the external additive therein cannot cover those buried in the surface of the toner and left therefrom. When greater than 0.4, the fluidity and transferability of the toner deteriorate because the surface thereof has too many undulations.

The area ratio is measured by the following method. First, a mesh having openings of 22 μm is placed on a glass plate. A toner is placed on the mesh and sieved upon application of vibration for 10 sec to uniformly place the toner on the glass plate in a small amount. The glass plate is photographed from beneath with a high-performance digital camera COOL PIX 5000 producing images having 4,920,000 pixels from Nikon Corporation. From the image, a contact area and a non-contact area of the toner to the glass plate can be identified. The image is analyzed in a personal computer using Image-Pro Plus from Planetron, Inc. In the image analysis, the contact area of the toner to the glass plate is blacked out, which is determined as a crater area. A black line is drawn on an outline of the whole toner, and a whole area surrounded by the line is determined as a whole projected area of the toner. Finally, the area ratio is determined by the following formula:

Crater area/(Whole projected area of the toner—Crater area)

Images of 100 or more of the toner are analyzed as above, and an average of the area ratios is determined as an area ratio of the toner.

The toner of the present invention may optionally further comprise an organic particulate resin, and the crater is formed from an existential status of the organic particulate resin. An organic particulate resin adheres to a convexity of the surface of the toner or another organic particulate resin happening to adhere thereto. The organic particulate resins are deformed by a stress and lapping over each other to form the surface of the toner with a crater.

Such a toner is specifically prepared by dry mixing of the organic particulate resin with the toner, and imparting a stress to the mixture to form a crust-shaped surface on the toner. Alternatively, after the toner is mixed with the organic particulate resin by wet mixing in a solvent, the mixture is heated upon application of shearing force with a stirring blade to adhere the organic particulate resin on the surface of the toner to form a crust-shaped surface thereon. Methods of forming the crater are not particularly limited, and the crater is easily formed with the deformable organic particulate resin. The organic particulate resin preferably has an average particle diameter of from 5 nm to 2 μm, and more preferably from 20 to 300 nm. When less than 5 nm, the organic particulate resin is too small to form a crater. When greater than 2 μm, a difference between a particle diameter of the toner and that of the organic particulate resin is so small that the deformed organic particulate resin cannot adhere to the surface of the toner.

The toner of the present invention preferably has a ratio (A/B) of an concentration A (%) of the organic particulate resin on the surface of the toner to a BET specific surface B ($m^2/g$) of from 1.1 to 2.1. The ratio (A/B) is a ratio of the organic particulate resin to a superficial area of a toner per a unit weight. When the ratio is small, there is a large space between the organic particulate resins. When large, there is a small space therebetween. Therefore, when the ratio (A/B) is less than 1.1, the organic particulate resins remaining on the surface of the toner largely project as a convexity or a rough multilayer, and the organic particulate resin prevents adherence between a binder resin in the toner and a transfer sheet, resulting in increase of minimum fixable temperature. Further, the organic particulate resin prevents a wax from exuding and releasability of the toner is not fully exerted, resulting in occurrence of offset. When greater than 2.1, the organic particulate resins remaining on the surface of the toner become a film over or thickly cover all the surface thereof, and prevents adherence between a binder resin in the toner and a transfer sheet, resulting in increase of minimum fixable temperature. Further, the organic particulate resin prevents a wax from exuding and releasability of the toner is not fully exerted, resulting in occurrence of offset.

The concentration A (%) of the organic particulate resin on the surface of the toner can be determined by a weight of the toner to a quantity of the organic particulate resin analyzed by pyrolysis gas chromatographic mass spectrometer. The BET specific surface B ($m^2/g$) can be measured according to a BET method using a specific surface measurer AUTOSORB 1 from Yuasa Ionics, Inc., wherein nitrogen gas is absorbed on a surface of the sample using a BET multipoint method.

The concentration A (%) of the organic particulate resin on the surface of the toner is preferably 0.5 to 4.0%, and more preferably from 0.5 to 3.0% per 100% of the toner. When the concentration A (%) is less than 5%, an amount of the organic particulate resin is too small to form a crater, and the toner has a smooth surface and is not fully charged with a friction, resulting in production of images having low image density and foggy background. When greater than 4.0%, the organic particulate resin completely covers the surface of the toner and the toner does not contact a fixer and the like, resulting in deterioration of the fixability.

The BET specific surface B ($m^2/g$) is preferably from 1.5 to 4.0 $m^2/g$. When less than 1.5 $m^2/g$, the organic particulate resins remaining on the surface of the toner become a film over or thickly cover all the surface thereof, and prevents adherence between a binder resin in the toner and a transfer sheet, resulting in increase of minimum fixable temperature. Further, the organic particulate resin prevents a wax from exuding and releasability of the toner is not fully exerted, resulting in occurrence of offset. When greater than 4.0 $m^2/g$, the organic particulate resins remaining on the surface of the toner largely project as a convexity or a rough multilayer, and the organic particulate resin prevents adherence between a binder resin in the toner and a transfer sheet, resulting in increase of minimum fixable temperature. Further, the organic particulate resin prevents a wax from exuding and releasability of the toner is not fully exerted, resulting in occurrence of offset.

The toner of the present invention preferably includes an inorganic particulate material. Specific preferred examples of suitable inorganic particulate material include silica, alumina, titanium oxide, barium titanate, magnesium titanate, calcium titanate, strontium titanate, zinc oxide, tin oxide, quartz sand, clay, mica, sand-lime, diatomearth, chromiumoxide, ceriumoxide, redironoxide, antimonytrioxide, magnesiumoxide, zirconium oxide, barium sulfate, barium carbonate, calcium carbonate, silicon carbide, silicon nitride, etc. These can be used alone or in combination to improve fluidity, developability and chargeability of the resultant toner. A surface treatment agent can increase the hydrophobicity of these external additives and prevent deterioration of fluidity and chargeability of the resultant toner even in high humidity. Any desired surface treatment agent may be used, depending on the properties of the treated particle of interest. Specific preferred examples of the surface treatment agent include silane coupling agents, silylating agents, silane coupling agents having an alkyl fluoride group, organic titanate coupling agents, aluminium coupling agents silicone oils and modified silicone oils.

Particularly, a hydrophobic silica and a hydrophobic titanium oxide, which are the silica and titanium oxide subjected to the above-mentioned surface treatment, are preferably used.

The inorganic particulate material preferably has a primary particle diameter of from 5 nm to 2 μm, and more preferably from 5 nm to 0.5 μm. In addition, a specific surface of the inorganic particulates measured by a BET method is preferably from 20 to 500 $m^2/g$. The content of the external additive is preferably from 0.01 to 5% by weight, and more preferably from 0.01 to 2.0% by weight based on total weight of the toner.

Further, a spherical silica having a particle diameter of from 80 to 300 nm, prepared by a sol-gel method, can be used. Since the silica easily slips and rolls on the surface of the toner, the silica is not easily buried and can protect other external additives having a small particle diameter from a stress between the toners and against a magnetic carrier. Even in the crater, the spherical silica contributes to further stabilize the fluidity and chargeability of the toner, preventing the other external additives from being buried.

A release agent is optionally included in the toner to prevent hot offset of the toner in a fixing process. The release agent included in the toner receives a heat and a pressure when the toner is fixed and appears on the surface of the toner in accordance with a deformation thereof to have releasability. The release agent is preferably involved in the toner without being exposed on the surface of the toner. A wax exposed on the surface of the toner adheres onto a surface of a friction charging member to deteriorate friction chargeability of the toner and agglutinates to deteriorate fluidity of the toner.

When the above-mentioned organic particulate resin is adhered on to the surface of the toner particle, the release agent included in the toner only exudes when the toner is fixed. Therefore, the organic particulate resin in the crater improves deterioration of chargeability of the toner.

A wax for use in preferred embodiments of the toner of the present invention has a low melting point of from 50 to 120° C. When such a wax is included in the toner, the wax is dispersed in the binder resin and serves as a release agent at a location between a fixing roller and the toner particles. Thereby, hot offset resistance can be improved without applying an oil to the fixing roller used. Specific examples of the release agent include natural waxes such as vegetable waxes, e.g., carnauba wax, cotton wax, Japan wax and rice wax; animal waxes, e.g., bees wax and lanolin; mineral waxes, e.g., ozokelite and ceresine; and petroleum waxes, e.g., paraffin waxes, microcrystalline waxes and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes and ether waxes. In addition, fatty acid amides such as 1,2-hydroxylstearic acid amide, stearic acid amide and phthalic anhydride imide; and low molecular weight crystalline polymers such as acrylic homopolymer and copolymers having a long alkyl group in their side chain, e.g., poly-n-stearyl methacrylate, poly-n-laurylmethacrylate and n-stearyl acrylate-ethyl methacrylate copolymers, can also be used.

The toner of the present invention preferably has a loose apparent density of mot less than 0.37 $g/cm^3$, and more preferably of from 0.40 to 0.50 g/cm$^3$. Controlling bulkiness of the toner, fluidity and feedability of the toner is improved, and the resultant developer has high fluidity, is uniformly charged and produces high-quality images with less uneven image density. Further, even in environments of high temperature and high humidity, and of low temperature and low humidity, the toner has good chargeability having less feebly and reversely charged, and produces images having less (foggy) background fouling. When the loose apparent density is less than 0.37 g/cm$^3$, the bulkiness of the toner is so high that the toner scatters when transferred. When greater than 0.70 g/cm$^3$, the toner does not have sufficient fluidity, and feedability and charge buildup capability thereof deteriorate, resulting in production of images having more uneven image density and toner scattering in an image forming apparatus.

The powder density is measured by a powder tester PTN from Hosokawa Micron Corp., wherein a toner passed through a mesh having openings of 350 μm is slowly put in a glass cylinder having a capacity of 100 mL and a calibration of 2 ml, and a weight of the glass cylinder including 100 mL of the toner is divided by 100 mL to determined the powder density.

The toner of the present invention preferably has a shape factor SF-1 of from 100 to 180, and a shape factor SF-2 of from 100 to 180.

Figure 1B:
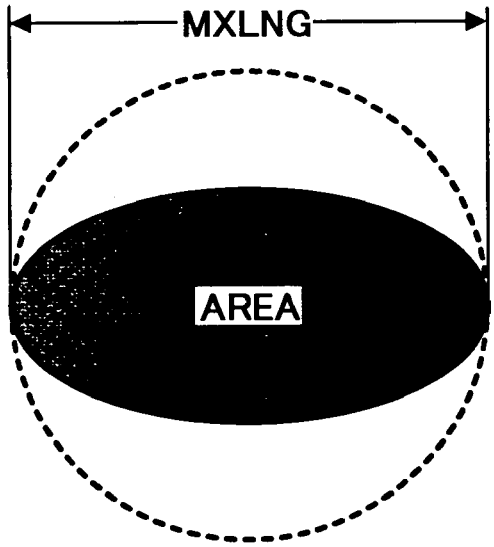

FIGS. 1A and 1B are schematic views illustrating shapes of toners for explaining shape factors SF-1 and SF-2

The shape factor SF-1 represents a degree of roundness of a toner, and is determined in accordance with the following formula (1):

$$SF\text{-}1=\{(MXLNG)^2/\text{AREA}\}\times(100\pi/4) \quad (1)$$

wherein MXLNG represents an absolute maximum length of a particle and AREA represents a projected area thereof.

When the SF-1 is close to 100, the shape of the toner is close to a sphere and the toner contacts the other toner and a photoreceptor at a point.

SF-2 represents the concavity and convexity of the shape of the toner, and specifically a square of a peripheral length of an image projected on a two-dimensional flat surface (PERI) is divided by an area of the image (AREA) and multiplied by 100 $\pi/4$ to determine SF-2 as the following formula (2) shows.

$$SF\text{-}2=\{(PERI)^2/\text{AREA}\}\times(100\pi/4) \quad (2)$$

When the SF-2 is close to 100, the surface of the toner has less concavity and convexity and is smooth. The surface of the toner preferably has moderate concavities and convexities to have better cleanability. However, when the SF-2 is greater than 180, the concavity and convexity is so noticeable that the toner scatters on the resultant images.

The shape factors are measured by photographing the toner with a scanning electron microscope (S-800) from Hitachi, Ltd. and analyzing the photographed image of the toner with an image analyzer Luzex III from NIRECO Corp.

The toner of the present invention preferably has a volume-average particle diameter Dv of from 3.0 to 8.0 μm and a ratio Dv/Dn of the volume-average particle diameter Dv to a number-average particle diameter Dn of from 1.00 to 1.40, and more preferably has a volume-average particle diameter Dv of from 3.0 to 6.0 μm and a ratio Dv/Dn of the volume-average particle diameter to the number-average particle diameter Dn of from 1.00 to 1.15. Such a toner has good heat resistant preservability, low-temperature fixability and hot offset resistance. Above all, the toner used in full color copiers produce images having good glossiness.

Typically, the smaller the toner particle diameter, the more advantageous it is for producing high-resolution and high-quality images. However, it is more disadvantageous for transferability and cleanability of the toner, and tends to produce images having insufficient image density and stripes due to the poor cleanability. In a toner having a weight-average particle diameter smaller than the range of the present invention, the toner is fusion bonded with the surface of the carrier in a two-component developer when stirred for long periods in an image developer and deteriorates the chargeability of the carrier. When used in a one-component developer, a toner film tends to form over the charging roller and the toner tends to be fusion bonded with a member, such as a blade forming a thin toner layer.

When Dv/Dn is greater than 1.40, charge quantity distribution of the resultant toner widens and the toner produces images having deteriorated image resolution.

These phenomena largely depend on a content of a fine powder, and particularly a ratio of a toner having a particle diameter not greater than 3.17 μm is preferably from 8 to 15% by number. When greater than 15%, adherence to a magnetic carrier of the toner occurs and charge stability thereof deteriorates. When less than 8%, the resultant toner has a difficulty in producing high resolution and quality images and a large variation of the particle diameters in many cases when the toner in a developer is fed and consumed.

The average particle diameter and particle diameter distribution of the toner can be measured by a Coulter counter TA-II and Coulter Multisizer II from Beckman Coulter, Inc. In the present invention, an Interface producing a number distribution and a volume distribution from Nikkaki Bios Co., Ltd. and a personal computer PC9801 from NEC Corp. are connected with the Coulter Multisizer II to measure the average particle diameter and particle diameter distribution.

The toner of the present invention has the shape of almost a sphere, which can be specified as follows.

Figure 2A:
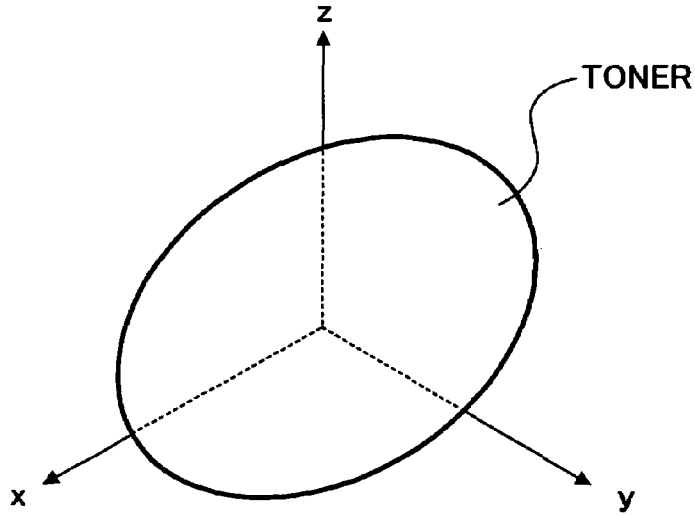
FIGS. 2A, 2B and 2C are schematic views illustrating a shape of the toner of the present invention.
Figure 2B:
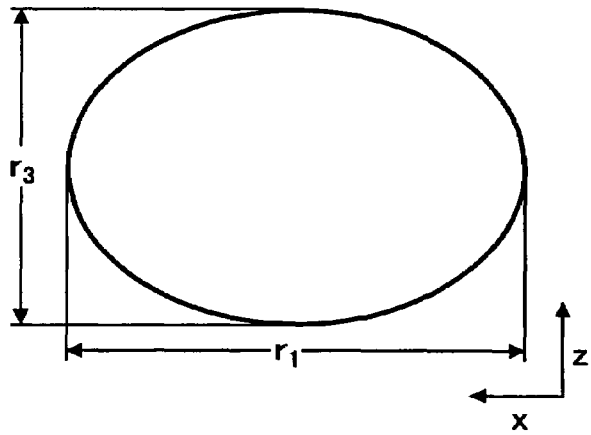
Figure 2C:
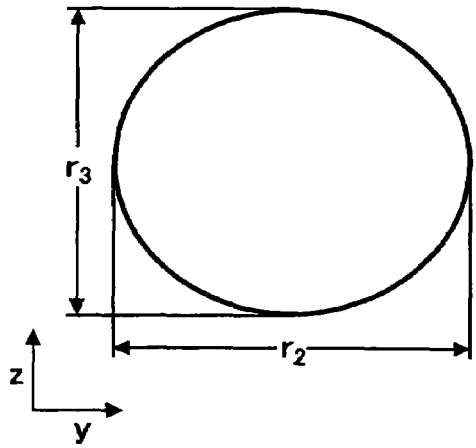

FIGS. 2A, 2B and 2C are schematic views illustrating a shape of the toner of the present invention. In FIGS. 2A, 2B and 2C, a ratio ($r_2/r_1$) of a minor axis $r_2$ to a major axis $r_1$ is preferably from 0.5 to 1.0, and a ratio ($r_3/r_2$) of a thickness $r_3$ to the minor axis ($r_2$) is preferably from 0.7 to 1.0.

When the ratio ($r_2/r_1$) is less than 0.5, the resultant toner which is away from the shape of a true sphere has high cleanability, but poor dot reproducibility and transferability. When the ratio ($r_3/r_2$) is less than 0.7, the resultant toner which is close to a flat shape does not scatter so much as an amorphous toner, but does not have so high a transferability as a spherical toner does. Particularly when the ratio ($r_3/r_2$) is 1.0, the resultant toner becomes a rotating body having the major axis as a rotating axis, and fluidity thereof improves.

The $r_1$, $r_2$ and $r_3$ are measured by observing the toner with a scanning electron microscope (SEM) and photographing the toner while changing a view angle.

The toner of the present invention is preferably formed by a crosslinking and/or an elongation reaction of a toner constituent liquid including at least polyester prepolymer having a functional group including a nitrogen atom, polyester, a colorant and a release agent are dispersed in an organic solvent in an aqueous medium. Hereinafter, the toner constituents will be explained.

The polyester can be formed by a polycondensation reaction between a polyol compound and a polycarbonate compound.

As the polyol (PO), diol (DIO) and triol (TO) can be used, and the DIO alone or a mixture of the DIO and a small amount of the TO is preferably used.

Specific examples of the DIO include alkylene glycol such as ethylene glycol, 1,2-propylene glycol, 1,3-propylene glycol, 1,4-butanediol, and 1,6-hexanediol; alkylene ether glycol such as diethylene glycol, triethylene glycol, dipropylene glycol, polyethylene glycol, polypropylene glycol and polytetramethylene ether glycol; alicyclic diol such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, alkylene glycol having 2 to 12 carbon atoms and adducts of bisphenol with an alkylene oxide are preferably used, and a mixture thereof is more preferably used. Specific examples of the TO include multivalent aliphatic alcohol having 3 to 8 or more valences such as glycerin, trimethylolethane, trimethylolpropane, pentaerythritol and sorbitol; phenol having 3 or more valences such as trisphenol PA, phenolnovolak, cresolnovolak; and adducts of the above-mentioned polyphenol having 3 or more valences with an alkylene oxide.

As the polycarbonate (PC), dicarboxylic acid (DIC) and tricarboxylic acid (TC) can be used. The DIC alone, or a mixture of the DIC and a small amount of the TC are preferably used. Specific examples of the DIC include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the TC include aromatic polycarboxylic acids having 9 to 20 carbon atoms such as trimellitic acid and pyromellitic acid. PC can be formed from a reaction between the PO and the above-mentioned acids anhydride or lower alkyl ester such as methyl ester, ethyl ester and isopropyl ester.

The PO and PC are mixed such that an equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polycondensation reaction between the PO and PC is performed by heating the Po and PC at from 150 to 280° C. in the presence of a known esterification catalyst such as tetrabutoxytitanate and dibutyltinoxide and removing produced water while optionally depressurizing to prepare polyester having a hydroxyl group. The polyester preferably has a hydroxyl value not less than 5, and an acid value of from 1 to 30 and more preferably from 5 to 20. When the polyester has an acid value within the range, the resultant toner tends to be negatively charged to have good affinity with a recording paper and low-temperature fixability of the toner on the recording paper improves. However, when the acid value is greater than 30, the resultant toner is not stably charged and the stability becomes worse by environmental variations.

The polyester preferably has a weight-average molecular weight of from 10,000 to 400,000, and more preferably form 20,000 to 200,000. When the weight-average molecular weight is less than 10,000, offset resistance of the resultant toner deteriorates. When greater than 400,000, low-temperature fixability thereof deteriorates.

The polyester preferably includes a urea-modified polyester besides an unmodified polyester formed by the above-mentioned polycondensation reaction. The urea-modified polyester is formed by reacting a polyisocyanate compound (PIC) with a carboxyl group or a hydroxyl group at the end of the polyester formed by the above-mentioned polycondensation reaction to form a polyester prepolymer (A) having an isocyanate group, and reacting amine with the polyester prepolymer (A) to crosslink and/or elongate a molecular chain thereof.

Specific examples of the PIC include aliphatic polyisocyanate such as tetramethylenediisocyanate, hexamethylenediisocyanate and 2,6-diisocyanatemethylcaproate; alicyclic polyisocyanate such as isophoronediisocyanate and cyclohexylmethanediisocyanate; aromatic diisocyanate such as tolylenedisocyanate and diphenylmethanediisocyanate; aroma aliphatic diisocyanate such as α, α, α', α'-tetramethylxylylenediisocyanate; isocyanurate; the above-mentioned polyisocyanate blocked with phenol derivatives, oxime and caprolactam; and their combinations.

The PIC is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low temperature fixability of the resultant toner deteriorates. When [NCO] has a molar ratio less than 1, a urea content in ester of the modified polyester decreases and hot offset resistance of the resultant toner deteriorates.

A content of the PIC in the polyester prepolymer (A) having a polyisocyanate group is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) reacted with the polyester prepolymer (A) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophorondiamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

The urea-modified polyester may include an urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

The urea-modified polyester can be prepared by a method such as a one-shot method. The PO and PC are heated at from 150 to 280° C. in the presence of a known esterification catalyst such as tetrabutoxytitanate and dibutyltinoxide and removing produced water while optionally depressurizing to prepare polyester having a hydroxyl group. Next, the polyisocyanate is reacted with the polyester at from 40 to 140° C. to form a polyester prepolymer (A) having an isocyanate group. Further, the amines (B) are reacted with the (A) at from 0 to 140° C. to form a urea-modified polyester.

When the PIC, and (A) and (B) are reacted, a solvent may optionally be used. Specific examples of the solvents include inactive solvents with the PIC such as aromatic solvents such as toluene and xylene; ketones such as acetone, methyl ethyl ketone and methyl isobutyl ketone; esters such as ethyl acetate; amides such as dimethylformamide and dimethylacetamide; and ethers such as tetrahydrofuran.

A reaction terminator can optionally be used in the crosslinking and/or elongation reaction between the (A) and (B) to control a molecular weight of the resultant urea-modified polyester. Specific examples of the reaction terminators include monoamines such as diethylamine, dibutylamine, butylamine and laurylamine; and their blocked compounds such as ketimine compounds.

The weight-average molecular weight of the urea-modified polyester is not less than 10,000, preferably from 20,000 to 10,000,000 and more preferably from 30,000 to 1,000,000. When the weight-average molecular weight is less than 10,000, hot offset resistance of the resultant toner deteriorates. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000 and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester can be included as a toner binder with the urea-modified polyester. A combination thereof improves low temperature fixability of the resultant toner and glossiness of color images produced thereby, and the combination is more preferably used than using the urea-modified polyester alone. Further, the unmodified polyester may include modified polyester except for the urea-modified polyester.

It is preferable that the urea-modified polyester at least partially mixes with the unmodified polyester to improve the low temperature fixability and hot offset resistance of the resultant toner. Therefore, the urea-modified polyester preferably has a structure similar to that of the unmodified polyester.

A mixing ratio between the unmodified polyester and urea-modified polyester is from 20/80 to 95/5, preferably from 70/30 to 95/5, more preferably from 75/25 to 95/5, and even more preferably from 80/20 to 93/7. When the urea-modified polyester is less than 5%, the hot offset resistance deteriorates, and in addition, it is disadvantageous to have both high temperature preservability and low temperature fixability.

In the present invention, the binder resin including the unmodified polyester and urea-modified polyester preferably has a glass transition temperature (Tg) of from 45 to 65° C., and preferably from 45 to 60° C. When the glass transition temperature is less than 45° C., the high temperature preservability of the toner deteriorates. When higher than 65° C., the low temperature fixability deteriorates.

As the urea-modified polyester is present on a surface of the toner particle, the resultant toner has better heat resistance preservability than known polyester toners even though the glass transition temperature of the urea-modified polyester is low.

Specific examples of the colorants for use in the present invention include any known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, redironoxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination. The content of the colorant in the toner is preferably from 1 to 15% by weight, and more preferably from 3 to 10% by weight, based on total weight of the toner.

The colorant for use in the present invention can be used as a master batch pigment when combined with a resin. Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; or their copolymers with vinyl compounds; polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among these materials, materials negatively charging a toner are preferably used.

The content of the charge controlling agent is determined depending on the species of the binder resin used, whether or not an additive is added and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large charge quantity, and thereby the electrostatic force of a developing roller attracting the toner increases, resulting in deterioration of the fluidity of the toner and decrease of the image density of toner images.

Specific examples of the release agent and inorganic particulate material include those mentioned earlier.

These charge controlling agent and release agents can be dissolved and dispersed after kneaded upon application of heat together with a master batch pigment and a binder resin, and can be added when directly dissolved and dispersed in an organic solvent.

The toner of the present invention is produced by the following method, but the method is not limited thereto.

1) A colorant, an unmodified polyester, a polyester prepolymer having an isocyanate group (A) and a release agent are dispersed in anorganic solvent to prepare a toner constituent liquid.

The organic solvent is preferably a volatile solvent having a boiling point less than 100° C. because of being easily removed after a toner particle is formed. Specific examples of the organic solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, methyl ethyl ketone and methyl isobutyl ketone. These can be used alone or in combination. Particularly, aromatic solvents such as the toluene and xylene and halogenated hydrocarbons such as the methylene chloride, 1,2-dichloroethane, chloroform and carbon tetrachloride. A content of the organic solvent is typically from 0 to 300 parts by weight, preferably from 0 to 100 parts by weight, and more preferably from 25 to 70 parts by weight per 100 parts by weight of the polyester prepolymer.

2) The toner constituent liquid is emulsified in an aqueous medium in the presence of a surfactant and a resin particulate material.

The aqueous medium may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

A content of the water medium is typically from 50 to 2,000 parts by weight, and preferably from 100 to 1,000 parts by weight per 100 parts by weight of the toner constituent liquid. When the content is less than 50 parts by weight, the toner constituent liquid is not well dispersed and a toner particle having a predetermined particle diameter cannot be formed. When the content is greater than 2,000 parts by weight, the production cost increases.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi (aminoethyl)glycin, di (octylaminoethyle)glycin, and N-alkyl-N, N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4)sulfonate, sodium-{omega-fluoroalkanoyl(C6-C8)-N-ethylamino}-1-propane sulfonate, fluoroalkyl(C11-C20)carboxylic acids and their metal salts, perfluoroalkyl carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Specific examples of the cationic surfactants, which can disperse an oil phase including toner constituents in water, include primary, secondary and tertiary aliphatic amines having a fluoroalkyl group, aliphatic quaternary ammonium salts such as erfluoroalkyl(C6-C10)sulfoneamidepropyltrimethylammonium salts, benzalkonium salts, benzetonium chloride, pyridinium salts, imidazolinium salts, etc. Specific examples of the marketed products thereof include SURFLONS-121 (from Asahi Glass Co., Ltd.); FRORARD FC-135 (from Sumitomo 3M Ltd.); UNIDYNE DS-202 (from Daikin Industries, Ltd.); MEGAFACE F-150 and F-824 (from Dainippon Ink and Chemicals, Inc.); ECTOP EF-132 (from Tohchem Products Co., Ltd.); FUTARGENT F-300 (from Neos); etc.

Specific examples of the organic particulate resin include those mentioned earlier. In addition, inorganic dispersants such as tricalcium phosphate, calcium carbonate, titanium oxide, colloidal silica and hydroxy apatite can also be used.

As dispersants which can be used in combination with the above-mentioned organic particulate resin and inorganic compounds, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared. At this point, the particle diameter (2 to 20 μm) means a particle diameter of particles including a liquid). When a high-speed shearing type dispersion machine is used, the rotation speed is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 40 to 98° C.

3) While an emulsion is prepared, amines (B) are included therein to be reacted with the polyester prepolymer (A) having an isocyanate group.

This reaction is accompanied by a crosslinking and/or a elongation of a molecular chain. The reaction time depends on reactivity of an isocyanate structure of the prepolymer (A) and amines (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

4) After the reaction is terminated, an organic solvent is removed from an emulsified dispersion (a reactant), which is washed and dried to form a toner particle.

The prepared emulsified dispersion (reactant) is gradually heated while stirred in a laminar flow, and an organic solvent is removed from the dispersion after stirred strongly when the dispersion has a specific temperature to from a toner particle having a shape of spindle. When an acid such as calcium phosphate or a material soluble in alkaline is used as a dispersant, the calcium phosphate is dissolved with an acid such as a hydrochloric acid and washed with water to remove the calcium phosphate from the toner particle. Besides this method, it can also be removed by an enzymatic hydrolysis.

Before or after the above-mentioned process of removing the solvent and washing, there may be a process of aging the toner particle by leaving the emulsified dispersion for a specific time at a specific temperature. This can make the toner particle have a desired particle diameter. The aging process is preferably performed at from 25 to 50° C., and for from 10 min to 23 hrs.

5) A charge controlling agent is beat in the toner particle, and inorganic fine particles such as silica fine particles and titanium oxide fine particles are externally added thereto to form a toner.

Known methods using a mixer, etc. are used to beat in the charge controlling agent and to externally add the inorganic fine particles.

Thus, a toner having a small particle diameter and a sharp particle diameter distribution can be obtained. Further, the strong agitation in the process of removing the organic solvent can control a shape of the toner from a spheric shape to a spindle shape, and a morphology of the surface thereof from being smooth to pickled-plum-shaped.

The toner of the present invention can be used for a two-component developer in which the toner is mixed with a magnetic carrier. A content of the toner is preferably from 1 to 10 parts by weight per 100 parts by weight of the carrier. Specific examples of the magnetic carrier include known carrier materials such as iron powders, ferrite powders, magnetite powders, magnetic resin carriers, which have a particle diameter of from about 20 to about 200 μm. A surface of the carrier may be coated by a resin. Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethyl methacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins. An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or a non-magnetic developer without a carrier.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 83 parts of methacrylate, 110 parts of butylacrylate and 1 part of persulfate ammonium were mixed in a reactor vessel including a stirrer and a thermometer, and the mixture was stirred for 15 min at 400 rpm to prepare a white emulsion therein. The white emulsion was heated to have a temperature of 75° C. and reacted for 5 hrs. Further, 30 parts of an aqueous solution of persulfate ammonium having a concentration of 1% were added thereto and the mixture was reacted for 5 hrs at 75° C. to prepare a [particulate resin dispersion liquid 1] of a vinyl resin (a copolymer of a sodium salt of an adduct of styrene-methacrylate-butylacrylate-sulfuric ester with ethyleneoxide methacrylate). The [particulate resin dispersion liquid 1] was measured by LA-920 to find a volume-average particle diameter thereof was 0.10 μm. A part of the [particulate resin dispersion liquid 1] was dried to isolate a resin component therefrom. The resin component had a Tg of 57° C.

990 parts of water, 80 parts of the [particulate resin dispersion liquid 1], 40 parts of an aqueous solution of sodium dodecyldiphenyletherdisulfonate having a concentration of 48.5% (ELEMINOL MON—7 from Sanyo Chemical Industries, Ltd.) and 90 parts of ethyl acetate were mixed and stirred to prepare a lacteous liquid, i.e., an [aqueous phase 1].

220 parts of an adduct of bisphenol A with 2 moles of ethyleneoxide and 561 parts of an adduct of bisphenol A with 3 moles of propyleneoxide, 218 parts terephthalic acid, 48 parts of an adipic acid and 2 parts of dibutyltinoxide were reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs, 45 parts of a trimellitic acid anhydride were added therein and the mixture was reacted for 2 hrs at normal pressure and 180° C. to prepare a [low-molecular-weight polyester 1]. The [low-molecular-weight polyester 1] had a number-average molecular weight of 2,500, a weight-average molecular weight of 6,700, a Tg of 43° C. and an acid value of 25.

682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 7 hrs at a normal pressure and 230° C. Further, after the mixture was depressurized to 10 to 15 mm Hg and reacted for 5 hrs to prepare an [intermediate polyester 1]. The intermediate polyester 1 had a number-average molecular weight of 2,100, a weight-average molecular weight of 9,500, a Tg of 55° C. and an acid value of 0.5 and a hydroxyl value of 49.

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

170 parts of isophorondiamine and 75 parts of methyl ethyl ketone were reacted at 50° C. for 5 hrs in a reaction vessel including a stirrer and a thermometer to prepare a [ketimine compound 1]. The [ketimine compound 1] had an amine value of 418.

40 parts of carbon black REGAL 400R from Cabot Corp., 60 parts of a binder resin, i.e., a polyester resin RS-801 having an acid value of 10, a Mw of 20,000 and a Tg of 64° C. and 30 parts of water were mixed by a HENSCHEL mixer to prepare a water-logged pigment agglomerate. This was kneaded by a two-roll mil having a surface temperature of 130° C. for 45 min, extended upon application of pressure, cooled and pulverized by a pulverizer to prepare a [master batch 1] having a particle diameter of 1 mm.

378 parts of the [low-molecular-weight polyester 1], 100 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [master batch 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr
peripheral disc speed of 6 m/sec, and
filling zirconia beads having diameter 0.5 mm
for 80% by volume.

Next, 1,324 parts of an ethyl acetate solution of the [low-molecular-weight polyester 1] having a concentration of 65% were added to the [material solution 1] and the mixture was stirred by the beads mill for one pass under the same conditions to prepare a [pigment and wax dispersion liquid 1]. The [pigment and wax dispersion liquid 1] had a solid content concentration of 50%.

648 parts of the [pigment and wax dispersion liquid 1], 154 parts of the [prepolymer 1] and 6.6 parts of the [ketimine compound 1] were mixed in a vessel by a TK-type homomixer from Tokushu Kika Kogyo Co., Ltd. at 5,000 rpm for 1 min. 1,200 parts of the [aqueous phase 1] were added to the mixture and mixed by the TK-type homomixer at 13,000 rpm for 20 min to prepare an [emulsified slurry 1].

1,00 parts of the [emulsified slurry 1] were mixed in an aqueous solution including 1,365 parts of ion-exchanged water and 35 parts carboxymethyl cellulose CMC DAICEL-1280 from DAICEL CHEMICAL INDUSTRIES, LTD. by a TK-type homomixer from Tokushu Kika Kogyo Co., Ltd. at 2,000 rpm for 1 hr to prepare a [homeotic slurry 1].

The [homeotic slurry 1] was put in a vessel including a stirrer and a thermometer, a solvent was removed therefrom at 30° C. for 8 hrs and the slurry was aged at 45° C. for 4 hrs to prepare a [dispersion slurry 1].

After the [dispersion slurry 1] was filtered under reduced pressure to prepare a filtered cake, 100 parts of ion-exchanged water were added to the filtered cake and mixed by the TK-type homomixer at 12,000 rpm for 10 min, and the mixture was filtered.

Further, 100 parts of an aqueous solution of 10% sodium hydrate were added to the filtered cake and mixed by the TK-type homomixer at 12,000 rpm for 10 min upon application of ultrasonic vibration, and the mixture was filtered under reduced pressure. This ultrasonic alkaline washing was performed again (Two ultrasonic alkaline washings).

Further, 100 parts of 10% hydrochloric acid were added to the filtered cake and mixed by the TK-type homomixer at 12,000 rpm for 10 min, and the mixture was filtered.

Further, 300 parts of ion-exchange water were added to the filtered cake and mixed by the TK-type homomixer at 12,000 rpm for 10 min, and the mixture was filtered. This operation was repeated again to prepare a filtered cake 1. The filtered cake 1 was dried by an air drier at 45° C. for 48 hrs and sieved by a mesh having an opening of 75 μm to prepare a toner particle 1. An concentration of organic particulate resin and BET specific area of the toner particle 1 are shown in Table 1.

Next, 100 parts of the toner particle 1 and 0.3 parts of charge controlling agent BONTRON E-84 from Orient Chemical Industries, Ltd. were mixed by a Q-type mixer from Mitsui Mining Co., Ltd., wherein a peripheral speed of a turbine blade thereof was 50 m/sec. This mixing operation included 5 cycles of 2 min mixing (total 10 min) and 1 min pausing.

Further, 0.5 parts of hydrophobic silica H2000 from Clariant (Japan) K.K. were mixed therein at a peripheral speed of 15 m/sec, which included 5 cycles of 30 sec mixing and 1 min pausing, to prepare a toner 1.

Figure 3:
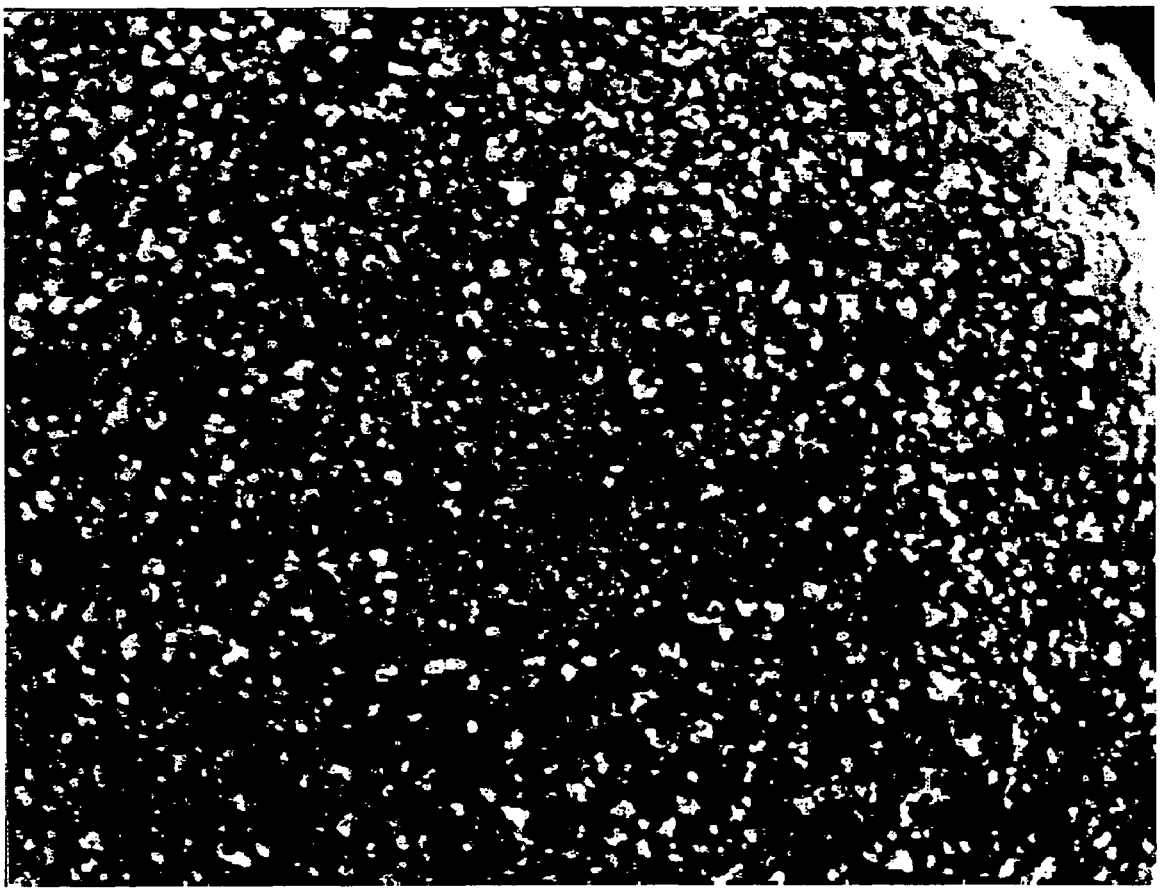
FIG. 3 is a SEM photograph of the surface of the toner in Example 1.

FIG. 3 is a SEM photograph of the surface of the toner 1. As the SEM photograph shows, the external additives are not uniformly present thereon and gather more in a crater than on the other places.

The procedure for preparation of the toner 1 in Example 1 was repeated to prepare toners 2 to 10 except for changing the revolution number and time of the TK-type homomixer in the emulsifying process; an amount of a thickener, the revolution number and time of the TK-type homomixer in the homeotic process; and the temperature and in the drying process. Properties of the toners 1 to 10 are shown in Table 1.

TABLE 1

| | | Toner particle | | | Toner | | | |
|---|---|---|---|---|---|---|---|---|
| | | | BET | | | | | |
| | Toner No. | Concentration of organic particulate resin A(%) | specific surface area B($m^2$/g) | A/B | Depth of crater (μM) | Area ratio of crater | Average circularity | Loose apparent density (g/$cm^3$) |
| Example 1 | Toner 1 | 1.5 | 1.2 | 1.3 | 0.06 | 0.4 | 0.957 | 0.41 |
| Example 2 | Toner 2 | 1.7 | 1.5 | 1.1 | 0.04 | 0.3 | 0.953 | 0.37 |
| Example 3 | Toner 3 | 1.3 | 1.1 | 1.2 | 0.09 | 0.1 | 0.960 | 0.39 |
| Example 4 | Toner 4 | 1.9 | 1.4 | 1.4 | 0.02 | 0.2 | 0.948 | 0.40 |
| Example 5 | Toner 5 | 1.8 | 1.6 | 1.1 | 0.03 | 0.4 | 0.950 | 0.38 |
| Example 6 | Toner 6 | 2.0 | 1.0 | 2.0 | 0.04 | 0.2 | 0.942 | 0.42 |
| Comparative Example 1 | Toner 7 | 1.8 | 2.1 | 0.9 | 0.01 | 0.0 | 0.951 | 0.35 |
| Comparative Example 2 | Toner 8 | 1.5 | 1.3 | 1.2 | 0.03 | 0.4 | 0.935 | 0.40 |
| Comparative Example 3 | Toner 9 | 2.1 | 2.8 | 0.8 | 0.01 | 0.2 | 0.959 | 0.37 |
| Comparative Example 4 | Toner 10 | 2.3 | 1.7 | 1.4 | 0.06 | 0.1 | 0.928 | 0.38 |

The following materials were mixed and dispersed by a homomixer for 20 min to prepare a coating liquid. The coating liquid was coated by a fluidized-bed coater on 1,000 parts of spherical magnetite having a particle diameter of 50 μm to prepare a magnetic carrier.

| | |
|---|---|
| Silicone resin (organo straight silicone) | 100 |
| Toluene | 100 |
| γ-(2-aminoethyl)aminopropyltrimethoxysilane | 5 |
| Carbon black | 10 |

5 parts of each of the toners 1 to 10 and 95 parts of the magnetic carrier were mixed by a TURBLA mixer to prepare two-component developers 1 to 10.

An image forming apparatus used for evaluating the developers will be explained.

Figure 4:
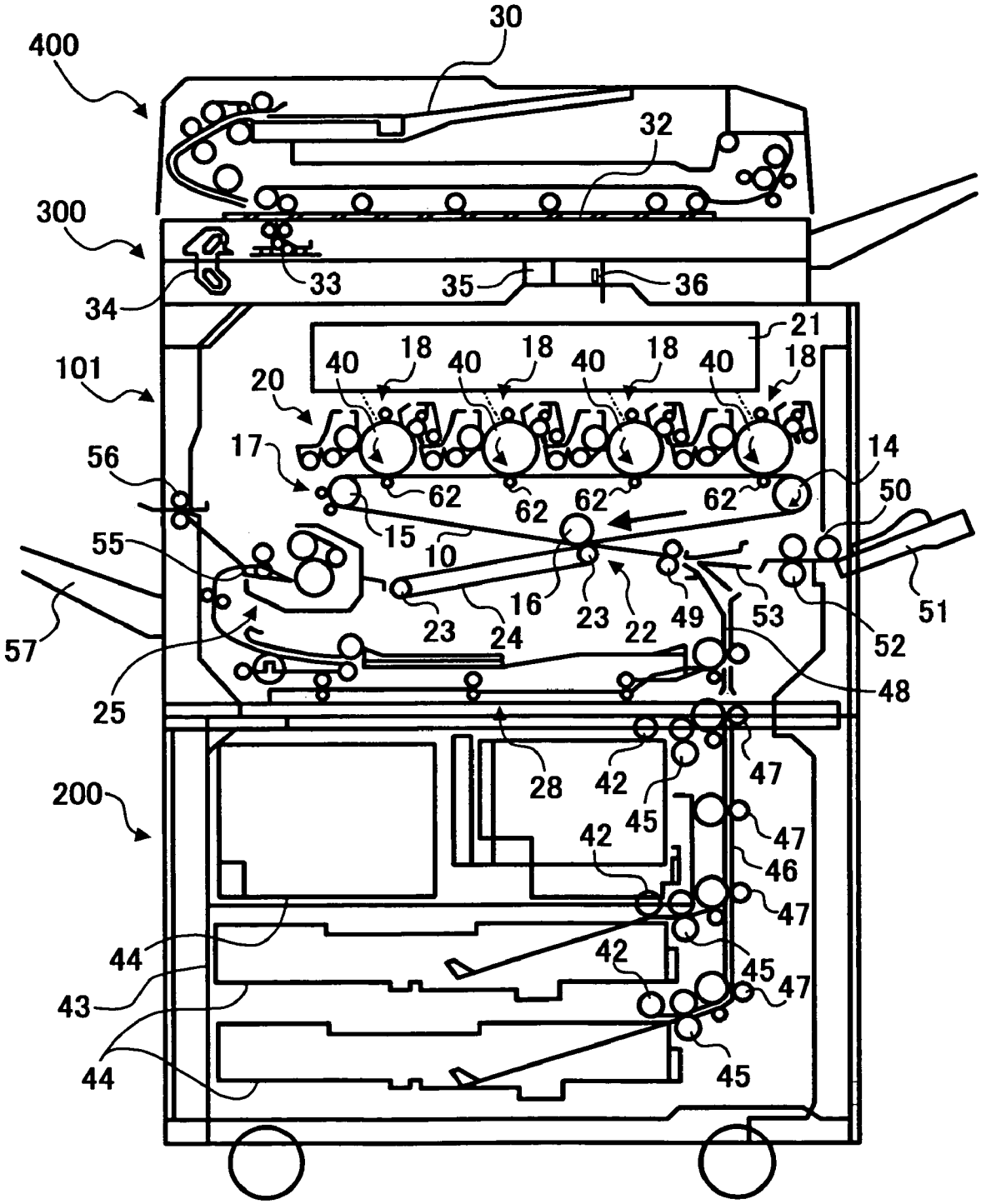
FIG. 4 is a schematic view illustrating an embodiment of the image forming apparatus of the present invention, which is a tandem-type image forming apparatus using a indirect transfer method.

FIG. 4 is a schematic view illustrating an embodiment of the image forming apparatus of the present invention, which is a tandem-type image forming apparatus using a indirect transfer method. Only an image forming unit 18 was used to form images.

Numeral 100 is a copier, 200 is a paper feeding table, 300 is a scanner on the copier 100 and 400 is an automatic document feeder (ADF) on the scanner 300. The copier 100 includes an intermediate transferer 10 having the shape of an endless belt, and is suspended by three suspension rollers 14, 15 and 16 and rotatable in a clockwise direction.

On the left of the suspension roller 15, an intermediate transferer cleaner 17 is located to remove a residual toner on an intermediate transferer 10 after an image is transferred.

Above the intermediate transferer 10, 4 image forming units 18 for yellow, cyan, magenta and black colors are located in line from left to right along a transport direction of the intermediate transferer 10 to form a tandem image forming apparatus 20. The image forming unit 18 may be a process cartridge including an image developer 61 and at least one of photoreceptor 40, a charger 60 and a cleaner 63. The process cartridge is detachable with the image forming apparatus 100 and can be exchanged in a body, which improves convenience for a user using the apparatus. Further, the image developer 61 includes a toner concentration sensor (not shown).

Above the tandem image forming apparatus 20, an image developer 21 is located.

On the opposite side of the tandem image forming apparatus 20 across the intermediate transferer 10, a second transferer 22 is located. The second transferer 22 includes a an endless second transfer belt 24 and two rollers 23 suspending the endless second transfer belt 24, and is pressed against the suspension roller 16 across the intermediate transferer 10 and transfers an image thereon onto a sheet.

Beside the second transferer 22, a fixer 25 fixing a transferred image on the sheet is located. The fixer 25 includes an endless belt 253 and a pressure roller 254 pressed against the belt.

The second transferer 22 also includes a function of transporting the sheet an image is transferred on to the fixer 25. As the second transferer 22, a transfer roller and a non-contact charger may be used. However, they are difficult to have such a function of transporting the sheet.

In FIG. 4, below the second transferer 22 and the fixer 25, a sheet reverser 28 reversing the sheet to form an image on both sides thereof is located in parallel with the tandem image forming apparatus 20.

An original is set on a table 30 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the original.

When a start switch (not shown) is put on, a drive motor (not shown) rotates one of the suspension rollers 14, 15 and 16 such that the other two rollers are driven to rotate, to rotate the intermediate transferer 10. At the same time, each of the image forming units 18 rotates the photoreceptor 40 and forms a single-colored image, i.e., a black image, a yellow image, a magenta image and cyan image on each photoreceptor 40. The single-colored images are sequentially transferred onto the intermediate transferer 10 to form a full-color image thereon.

On the other hand, when start switch (not shown) is put on, one of paper feeding rollers 42 of paper feeding table 200 is selectively rotated to take a sheet out of one of multiple-stage paper cassettes 44 in a paper bank 43. A separation roller 45 separates sheets one by one and feed the sheet into a paper feeding route 46, and a feeding roller 47 feeds the sheet into a paper feeding route 48 of the copier 100 to be stopped against a resist roller 49.

Alternatively, a paper feeding roller 50 is rotated to take a sheet out of a manual feeding tray 51, and a separation roller 52 separates sheets one by one and feed the sheet into a paper feeding route 53 to be stopped against a resist roller 49.

Then, in timing with a synthesized full-color image on the intermediate transferer 10, the resist roller 49 is rotated to feed the sheet between the intermediate transferer 10 and the second transferer 22, and the second transferer transfers the full-color image onto the sheet.

The sheet the full-color image is transferred thereon is fed by the second transferer 22 to the fixer 25. The fixer 25 fixes the image thereon upon application of heat and pressure, and the sheet is discharged by a discharge roller 56 onto a catch tray 57 through a switch-over click 55. Otherwise, the switch-over click 55 feeds the sheet into the sheet reverser 28 reversing the sheet to a transfer position again to form an image on the backside of the sheet, and then the sheet is discharged by the discharge roller 56 onto the catch tray 57.

On the other hand, the intermediate transferer 10 after transferring an image is cleaned by the intermediate transferer cleaner 17 to remove a residual toner thereon after the image is transferred, and ready for another image formation by the tandem image forming apparatus 20.

After 100,000 images of A4 horizontal chart (image pattern A) having repeated black and blank images at 1 cm intervals in a direction perpendicular to a rotation direction of a developing sleeve were produced by the image forming apparatus with the two-component developer, the following images were produced to evaluate the images.

Background Fouling

While a blank image was developed, the image forming apparatus was turned off to transfer the developer on the photoreceptor after developed onto an adhesive tape. A difference of image density between the adhesive tape and a brand-new adhesive tape was measured by 938 spectrodensitometer from X-Rite, Inc.

Image Density

An A4 solid checker (1 cm×1 cm) image was produced and the image density of 5 points thereof was measured by X-Rite from X-Rite, Inc., and an average thereof was ranked as follows:

○: good

Δ: acceptable

X : poor

The evaluation results are shown in Table 2.

TABLE 2

| | Toner | Background fouling | | | Image | Comprehensive |
|---|---|---|---|---|---|---|
| | No. | Start | 10,000 | 100,000 | density | evaluation |
| Example 1 | Toner 1 | 0.00 | 0.00 | 0.00 | ○ | ○ |
| Example 2 | Toner 2 | 0.00 | 0.01 | 0.01 | ○ | ○ |
| Example 3 | Toner 3 | 0.00 | 0.01 | 0.01 | ○ | ○ |
| Example 4 | Toner 4 | 0.00 | 0.00 | 0.01 | ○ | ○ |
| Example 5 | Toner 6 | 0.00 | 0.00 | 0.00 | ○ | ○ |
| Example 6 | Toner 6 | 0.00 | 0.01 | 0.02 | ○ | ○ |
| Comparative Example 1 | Toner 7 | 0.01 | 0.02 | 0.10 | X | X |
| Comparative Example 2 | Toner 8 | 0.00 | 0.03 | 0.04 | ○ | Δ |

TABLE 2-continued

| | Toner | Background fouling | | | Image | Comprehensive |
|---|---|---|---|---|---|---|
| | No. | Start | 10,000 | 100,000 | density | evaluation |
| Comparative Example 3 | Toner 9 | 0.01 | 0.02 | 0.07 | Δ | X |
| Comparative Example 4 | Toner 10 | 0.02 | 0.03 | 0.06 | Δ | X |

As apparently shown in Table 2, in Examples 1 to 6, high-quality images without background fouling were produced at start and even after 100,000 images were produced. In addition, the image density practically had no problem and comprehensive evaluation was good. However, in Comparative Examples 1 to 4, even though no background fouling at start, but became worse and the image density deteriorated after 100,000 images were produced.

This application claims priority and contains subject matter related to Japanese Patent Application No. 2004-044257 filed on Feb. 20, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising, at least one of each of the following components:

a binder resin;

a colorant;

a release agent; and an external additive, wherein the toner has an average circularity of from 0.940 to 0.965 and comprises, on the toner surface, at least one crater having a depth of from 0.02 to 0.1 μm, wherein the at least one crater contains an amount of the external additive per unit of surface area that is larger than an average amount of the external additive per unit of surface area thereof on the toner.

2. The toner of claim 1, wherein a ratio of an area of the at least one crater to an area of a remainder of the toner surface is from 0.1 to 0.4, wherein the remainder of the toner surface comprises surface area other than the surface of the crater being measured.

3. The toner of claim 1, further comprising an organic particulate resin, wherein the crater is formed by the organic particulate resin.

4. The toner of claim 3, wherein a ratio (A/B) of a concentration (A), in units of percent of the organic particulate resin, to a BET specific surface area (B), in units of $m^2/g$ thereof, is from 1.1 to 2.1.

5. The toner of claim 1, wherein the toner has a loose apparent density not less than 0.37 $g/cm^3$.

6. The toner of claim 1, wherein the toner has a first shape factor SF-1 of from 100 to 180, and a second shape factor SF-2 of from 100 to 180.

7. The toner of claim 1, wherein the toner has a volume-average particle diameter (Dv) of from 3.0 to 8.0 μm, and a ratio (Dv/Dn) of the volume-average particle diameter (Dv) to a number-average particle diameter (Dn) of from 1.00 to 1.40.

8. The toner of claim 7, wherein the toner comprises particles having a volume-average particle diameter not greater than 3.17 μm in an amount of from 8 to 15% by number.

9. The toner of claim 1, wherein the toner has a spindle shape, and wherein a ratio ($r_2/r_1$) of a major axis particle diameter ($r_1$) of the toner to a minor axis particle diameter ($r_2$) thereof is from 0.5 to 0.8 and a ratio ($r_3/r_2$) of a thickness ($r_3$) of the toner to the minor axis particle diameter ($r_2$) thereof is from 0.7 to 1.0.

10. The toner of claim 1, wherein the toner is prepared by a method comprising:

dissolving or dispersing a toner composition comprising a first binder resin and a second binder resin comprising a modified polyester resin, in an organic solvent to prepare a solution or a dispersion;

mixing the solution or the dispersion with a compound having an active hydrogen atom, in an aqueous medium comprising a particulate resin material, to react the modified polyester with the compound to prepare an emulsion;

removing the organic solvent from the emulsion to prepare toner particles; and washing the toner particles to remove excess particles of the particulate resin material from a surface thereof.

11. The toner of claim 1, wherein the toner further comprises a magnetic particulate material.

12. A two-component developer comprising:

a silicone-coated magnetic carrier having an average particle diameter of from 20 to 50 μm; and the toner according to claim 1.

13. An image forming apparatus comprising:

a charger configured to charge an electrophotographic photoreceptor to form an electrostatic latent image thereon;

an image developer configured to develop the electrostatic latent image with the two-component developer according to claim 12 to form a toner image thereon;

a transferer configured to transfer the toner image onto a transfer sheet;

a fixer configured to fix the toner image on the transfer sheet; and a cleaner configured to clean the electrophotographic photoreceptor to remove the developer remaining thereon.

14. The image forming apparatus of claim 13, further comprising a process cartridge detachable from the image forming apparatus, wherein the process cartridge comprises:

the image developer; and at least one member selected from the group consisting of the electrophotographic photoreceptor, the charger and the cleaner.

15. The image forming apparatus of claim 13, further comprising a magnetic permeability sensor configured to control a toner concentration of the two-component developer.

* * * * *